US011674295B2

(12) United States Patent
Oliver

(10) Patent No.: US 11,674,295 B2
(45) **Date of Patent: *Jun. 13, 2023**

(54) ACCELERATED DRAIN APPARATUS AND METHOD FOR WALK-IN BATHTUB

(71) Applicant: Precision Polymers, LLC, Hohenwald, TN (US)

(72) Inventor: Daniel Oliver, Linden, TN (US)

(73) Assignee: PRECISION POLYMERS, LLC, Hohenwald, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/379,486

(22) Filed: Jul. 19, 2021

(65) Prior Publication Data

US 2021/0388588 A1 Dec. 16, 2021

Related U.S. Application Data

(63) Continuation of application No. 15/929,267, filed on Apr. 20, 2020, now Pat. No. 11,085,178.

(51) Int. Cl.
*E03C 1/23* (2006.01)
*A47K 3/00* (2006.01)

(52) U.S. Cl.
CPC ..... *E03C 1/2302* (2013.01); *A47K 3/006* (2013.01); *E03C 2001/2311* (2013.01); *E03C 2001/2317* (2013.01)

(58) Field of Classification Search
CPC ..... E03C 1/2302; E03C 2001/2311; E03C 2001/2317; A47K 3/006
USPC ..... 4/538, 541.1–541.6, 555, 650, 653, 679, 4/688
See application file for complete search history.

(56) References Cited

U.S. PATENT DOCUMENTS

| | | | |
|---|---|---|---|
| 210,334 | A | 11/1878 | Kinsmen |
| 1,805,560 | A | 5/1931 | Barta |
| 3,863,275 | A | 2/1975 | Brendgord |
| 4,716,605 | A | 1/1988 | Shepherd |
| 4,907,305 | A | 3/1990 | Teramachi |
| 4,974,310 | A | 12/1990 | Altman |

(Continued)

FOREIGN PATENT DOCUMENTS

JP 2002364933 12/2002

OTHER PUBLICATIONS

American Standard, Drain Overflow Installation, Quick Drain, www.americanstandard-us.com, American Standard (at least as early as Apr. 14, 2015).

(Continued)

*Primary Examiner* — Tuan N Nguyen
(74) *Attorney, Agent, or Firm* — Baker Donelson; Carl Davis

(57) ABSTRACT

An accelerated drain system for a walk-in bathtub with a water outlet in a side wall communicates water to a diverter valve biased to circulate the water in the bathtub and movable selectively to communicate water through a reverse check valve to a drain, the reverse check valve biased closed to prevent water flow and movable selectively to allow water flow to the drain, with a controller configured for moving the diverter valve selectively from the second position to the closed position for subsequent use of the walk-in bathtub. A method of rapid draining of a walk-in bathtub is disclosed.

27 Claims, 7 Drawing Sheets

(56) References Cited

U.S. PATENT DOCUMENTS

| | | | | |
|---|---|---|---|---|
| 5,012,535 | A * | 5/1991 | Klotzbach | A61H 33/027 4/541.4 |
| 5,123,123 | A | 6/1992 | Hart | |
| 5,351,345 | A | 10/1994 | Sills | |
| 5,898,958 | A | 5/1999 | Hall | |
| 7,886,372 | B2 | 2/2011 | Jacobs | |
| 8,407,823 | B2 | 4/2013 | Sorensen | |
| 8,549,678 | B2 | 10/2013 | Neidich | |
| 8,683,622 | B2 | 4/2014 | Ciechanowski | |
| 8,720,867 | B2 | 5/2014 | Cunningham | |
| 9,066,635 | B2 | 6/2015 | Campbell | |
| 10,655,309 | B1 | 5/2020 | Oliver | |
| 11,085,178 | B1 * | 8/2021 | Oliver | E03C 1/20 |
| 2005/0005349 | A1 | 1/2005 | Gardenier | |
| 2008/0189847 | A1 | 8/2008 | Yamasaki | |
| 2015/0366752 | A1 | 12/2015 | Hatley | |
| 2016/0271012 | A1 | 9/2016 | Xu | |
| 2017/0258274 | A1 | 9/2017 | Lee | |
| 2018/0192829 | A1 | 7/2018 | Manchiraju | |
| 2020/0154951 | A1 | 5/2020 | Kownacki | |
| 2022/0110489 | A1 | 4/2022 | Oliver | |

OTHER PUBLICATIONS

American Standard, Speed Connect.RTM Drain, www.americanstandard-us.com/learn/american-standard-advantage/innovations- /speed-connect, (at least as early as Apr. 14, 2015).

Safety Tubs LLC, electrical circuit diagrams, 2009.

Safety Tubs LLC, Safety Tubs luxury 60"×32" walk-in tub, www.safetytubs.com/acrylictubs/603237_options.php, Safety Tubs LLC, 902 West, North Carrier Parkway, Grand Prairie, TX 75050 (at least as early as Apr. 14, 2015).

Safety Tubs LLC, Walk-In Bath Installation Instructions and Owner's Manual, pp. 16, 20, and 24, Safety Tubs LLC, 902 West, North Carrier Parkway, Grand Prairie, TX 75050 (at least as early as Apr. 14, 2015).

Safety Tubs LLC, Minute Drain, Safety Tubs LLC, 902 West, North Carrier Parkway, Grand Prairie, TX 75050 (at least as early as Apr. 14, 2015).

* cited by examiner

ACCELERATED DRAIN APPARATUS AND METHOD FOR WALK-IN BATHTUB

TECHNICAL FIELD

The present invention relates to apparatus and methods for draining water from walk-in bathtubs. More particularly, the present invention relates to methods and apparatus selectively configured for circulating water within, and for draining water rapidly from, walk-in bathtubs.

BACKGROUND OF THE INVENTION

Walk-in bathtubs have in recent years become a popular addition for remodeling of bathrooms, or for installation in new construction as an added feature for bathrooms. Changing demographics, as well as personal choices for bathing, are making walk-in bathtubs a desired bathroom feature. Walk-in bathtubs typically have a closable door in a wall of the bathtub for entrance and egress by a bather. The sidewall defines a low threshold for the door, typically about 3 to 5 inches, for a bather to step over while entering or egressing the bathtub. In contrast, conventional bathtubs may have sidewalls of 18 inches, or more, over which a bather must pass for using the bathtub. Bathers who lack agility may find that stepping over the higher wall is difficult, and a bather may slip or fall and may become seriously injured.

Walk-in bathtubs feature a door and low threshold for passage of the bather, with a seal that restricts passage of water between the door and its frame in the side wall of the bathtub when filled with water from a supply. Walk-in bathtubs also differ from conventional bathtubs by providing a greater depth for the water cavity defined by the walls of the bathtub. This greater depth for walk-in bathtubs is typically accomplished with side walls having a greater height than conventional bathtubs and/or by a narrower width and/or length. Walk-in bathtubs also typically include a seat for a bather to sit while bathing.

While walk-in bathtubs enable persons to relaxingly bath with easier entrance and egress through a door, there are drawbacks to walk-in bathtub devices. For example, upon completion of bathing, the bather must continue to occupy the bathtub during the time that water drains from the cavity to a sanitary sewer. The water level must reach at least the threshold, in order for the door to be opened and permit egress of the bather. Gravity flow of water from a bathtub is slow, and typical walk-in bathtubs may take 6 to 8 minutes, or more, to drain sufficiently for opening the door for egress.

Accordingly, there is a need in the art for an improved apparatus selectively configured for circulating water within, and for draining water from, walk-in bathtubs. It is to such that the present invention is directed.

BRIEF SUMMARY OF THE INVENTION

The present invention meets the need in the art for an improvement in draining of water from a walk-in bathtub. More particularly, the present invention provides a quick drain system for a walk-in bathtub having a door in a side wall movable between a closed position with a seal for holding water within the bathtub and an open position for entering and egressing from the bathtub, said walk-in bath tub having a foot well portion for holding water below a threshold of the door and a water recirculation piping for communicating water to a plurality of jet openings in sidewalls of the bathtub. The quick drain system comprises a water outlet in a side wall of the bathtub and a water supply pipe for communicating water from the water outlet to a diverter valve. The diverter valve having a first position for communicating water to the water recirculation piping and a second position for communicating water to a water drain pipe and the water drain pipe connecting to a sanitary sewer pipe for draining water from the bathtub. A reverse check valve positioned in the water drain pipe prior to the connection with the sanitary sewer pipe and operable selectively to a check valve first position closed to prevent water flow from the diverter valve through the reverse check valve and to a check valve second position open to allow water flow from the diverter valve through the reverse check valve for draining of the bathtub, with means for operating selectively the reverse check valve to move to the check valve second position for draining water from the bathtub. Whereby the quick drain system, being closed to drainage of water from the bathtub by the reverse check valve, allows the bathtub to fill with water and the reverse check valve being selectively operated to move to the check valve second position and the diverter valve not in the first position, allows water in the bathtub above the upper edge to drain to the sanitary sewer pipe.

In another aspect, the present invention provides a method for rapid draining water from a walk-in bathtub having a door in a side wall movable between a closed position with a seal for holding water within the bathtub and an open position for entering and egressing from the bathtub, said walk-in bath tub having a foot well portion for holding water below a threshold of the door and a water recirculation piping for communicating water to a plurality of jet openings in sidewalls of the bathtub, comprising the steps of:

biasing a diverter valve in a quick drain system to a first position for communicating water from a water outlet in a side wall of the bathtub to the water recirculation piping, said diverter valve selectively movable to a second position for communicating water to a water drain pipe that connects to a sanitary sewer pipe, the water outlet lower than the threshold of the door; biasing a reverse check valve in the water drain pipe of the quick drain system to a check valve first position closed to prevent water flow from the diverter valve into the sanitary sewer pipe and moveable selectively to a check valve second position open to allow water flow from the water outlet through the diverter valve and the reverse check valve into the sanitary sewer pipe for draining of the bathtub;

moving the diverter valve to the second position; and moving the reverse check valve to the check valve second position, whereby water within the bathtub communicates through the water outlet through the diverter valve and the reverse check valve for draining, whereby the quick drain system, being closed to drainage of water from the bathtub by the diverter valve and the reverse check valve, allows the bathtub to fill with water and the reverse check valve being selectively operated to move to the check valve second position and the diverter valve not in the first position, allows water in the bathtub above the water outlet to drain to the sanitary sewer pipe.

Objects, advantages, and features of the present invention will become readily apparent upon a reading of the following detailed description in conjunction with the drawings and the appended claims.

DETAILED DESCRIPTION

Figure 1:
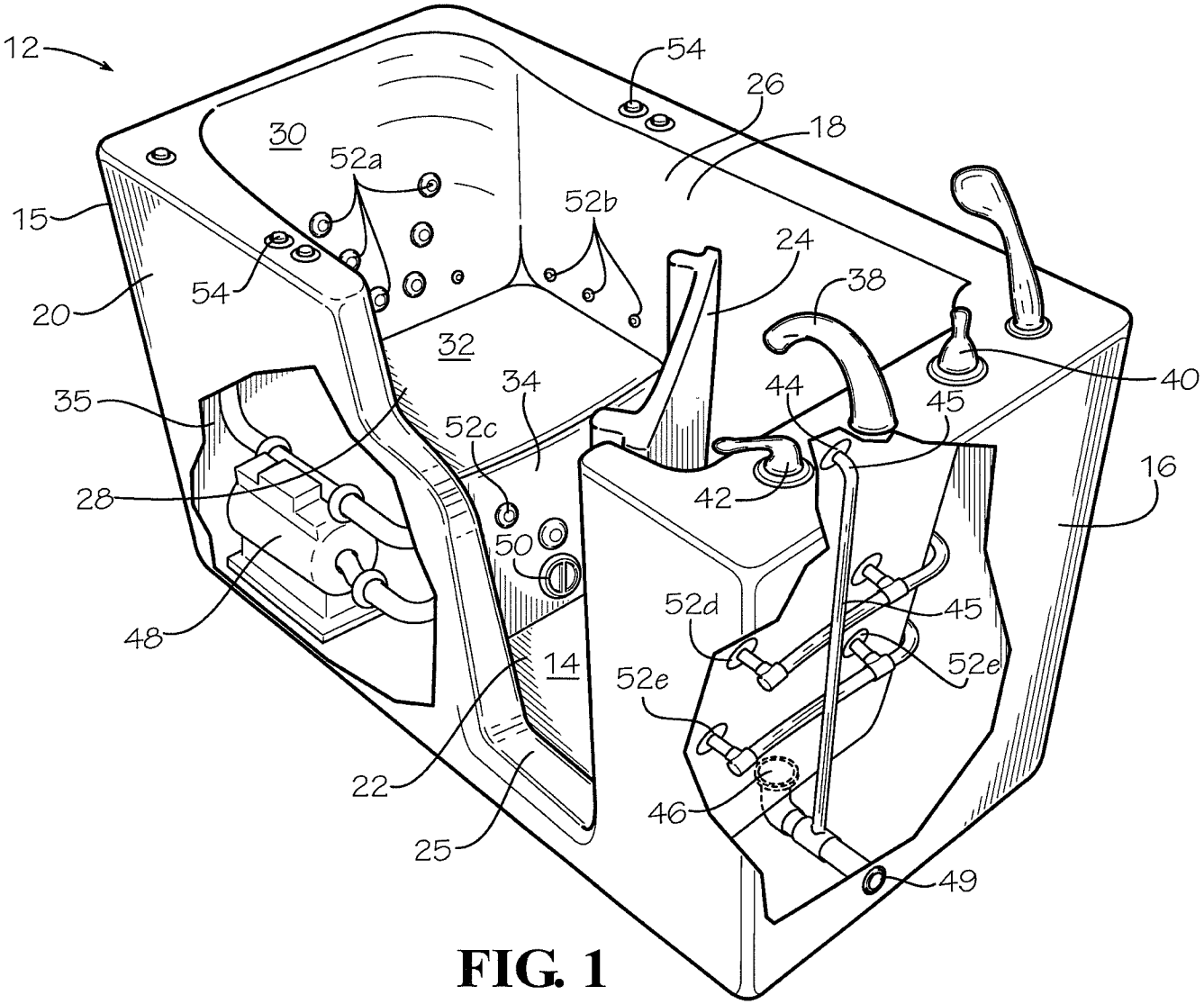
FIG. 1 illustrates in perspective cut-away view a walk-in bathtub configured with a rapid drain apparatus selectively configured for circulating water within, and for draining water from, the walk-in bathtub.
Figure 2:
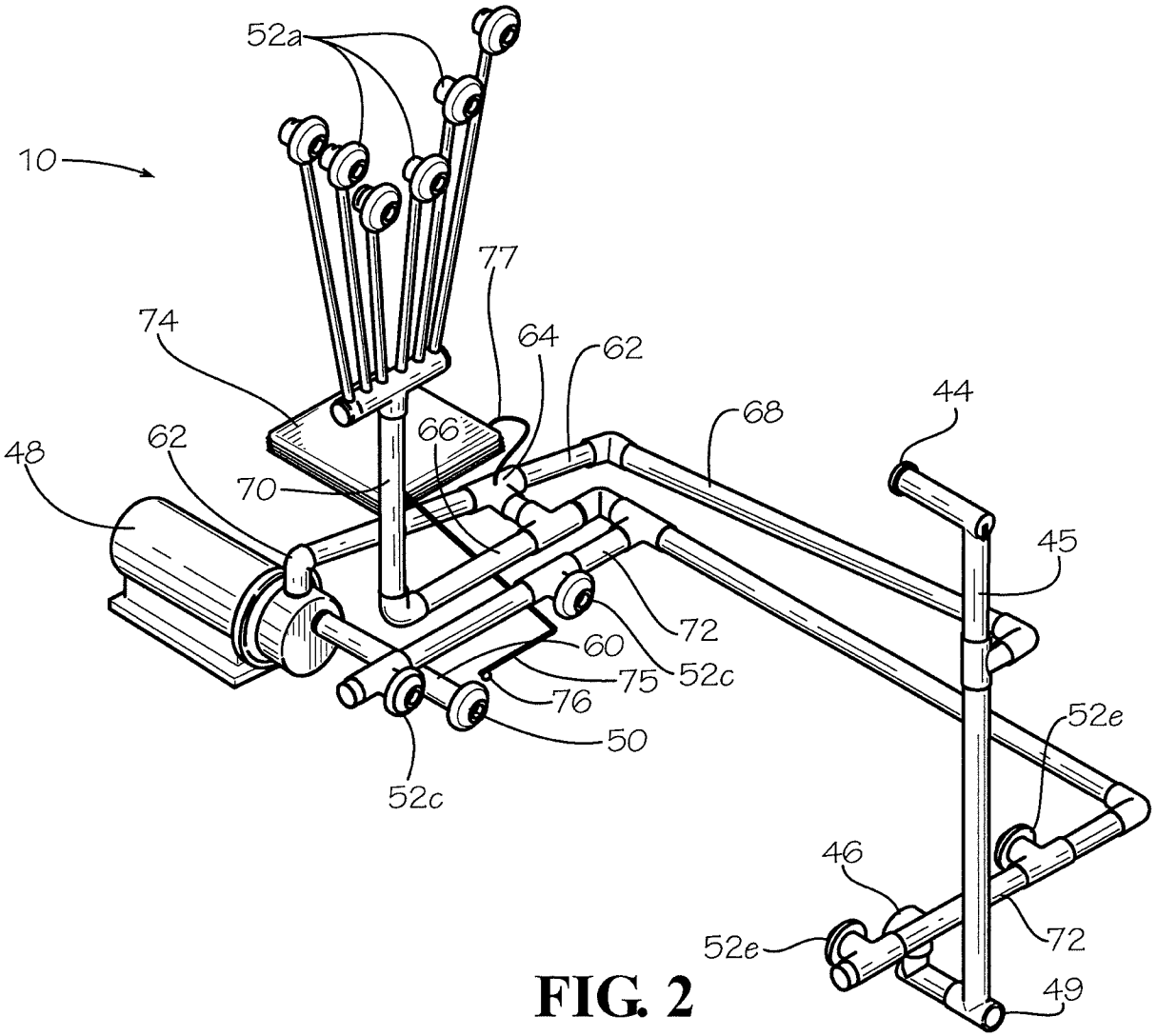
FIG. 2 illustrates in perspective view a rapid drain apparatus selectively configured for circulating water within, and for draining water from, a walk-in bathtub.

With reference to the drawings, in which like parts have like identifiers, FIG. 2 illustrates in perspective view a drain apparatus 10 configured in accordance with the present invention for circulating water within, and for draining water from, a walk-in bathtub 12 such as that illustrated in perspective partially cut-away view in FIG. 1. The walk-in bathtub 12 includes a floor 14, opposing end walls 15, 16, a back wall 18, and a front wall 20 that defines a passage 22 closed by a door 24 (illustrated in an open position). The passage 22 is defined by threshold 25. The door 24 selectively moves between the open position and a closed position. In the open position, a bather may enter and exit through the passageway 22. With the door 24 in the closed position, the bathtub 12 defines a cavity 26 for receiving and holding water for the bather. The bathtub 12 defines a seating area generally 28 with a back 30, a seat 32, and a foot well 34. The seating area 28 defines a compartment 35 in a lower portion of the bathtub 12 for holding jet water circulation equipment and piping. The illustrated embodiment includes a spout 38 that communicates through water supply valves 40, 42 for controlling the flow of hot and cold water into the cavity 26. An upper portion of the end wall 16 defines an overflow opening 44. A drain pipe 45 connects to the overflow opening and communicates through an outlet at a distal end that connects to a sanitary sewer line for draining water from the cavity 26. The floor 14 defines a main floor drain 46 in a lower portion. A connector pipe connects the main floor drain 46 through a tee-joint to the pipe 45 for communicating water from the cavity 26 to the drain. A pump 48 mounts in the compartment 35 below the seating area 28. The pump 48 connects to an intake 50 disposed in wall in a lower portion of the foot wall 34. An output of the pump 48 connects through one or more manifolds and conduits to a plurality of water nozzles or jets 52. The illustrated embodiment includes lumbar water jets 52*a*, body side jets 52*b*, back leg jets 52*c*, foot jets 52*d*, and front leg jets 52*e*. Control switches 54 operate to select the jets to which the pumped water communicates. Various configurations may be readily plumbed and configured with control switches as is conventional in the jetted bathtub field.

With reference to FIG. 2, the drain apparatus 10 includes the pump 48 that connects through an intake pipe 60 to the intake 50 that is open to the water cavity of the bathtub 12. An outlet pipe 62 of the pump 48 connects to a valve 64. The valve 64 operates to direct water flow from the pump 48 to a jets manifold 66 or to a drain conduit 68. The jets manifold 66 in the illustrated embodiment connects to a lumbar jets branch 70 and further to leg and foot jet branches generally 72. The lumbar jets branch 70 feeds a plurality of lumbar jets 52*a* mounted in the wall that defines the seat back 30. The drain conduit 68 connects to the pipe 45 intermediate the overflow opening 44 and the connection of the main floor drain 46. A controller 74 mounts in the compartment 35. The controller 74 is a programmable operating device, such as a microprocessor computer. A lower limit water sensor 76 mounts in a wall of the foot well proximate an upper extent of the suction intake 50. A wiring harness 75 connects the controller 74 to the sensor 76. Generally, the sensor 76 is disposed at a height proximate the height of the threshold 25. The sensor 76 signals the controller 74 as to the lower water level in the cavity 26. In the illustrated embodiment, the controller 74 also connects with a control wiring harness 77 to the valve 64. The controller 74 provides operation signals to the valve 64 to move the valve selectively from a first position to a second position. In the first position, the valve 64 is open for circulating water from the intake 50, through the pump 48, and to the jets manifold 66 for jetting communication of circulating water through respective ones of the jets 52. In the second position, the valve 64 is open for draining water from the cavity 26 by communicating water from the intake 50, through the pump 48, and through the drain conduit 68 to the drain pipe 45 and to the drain 49. The drain 49 couples to a sanitary sewer such as through a conventional j-trap.

Figure 2A:
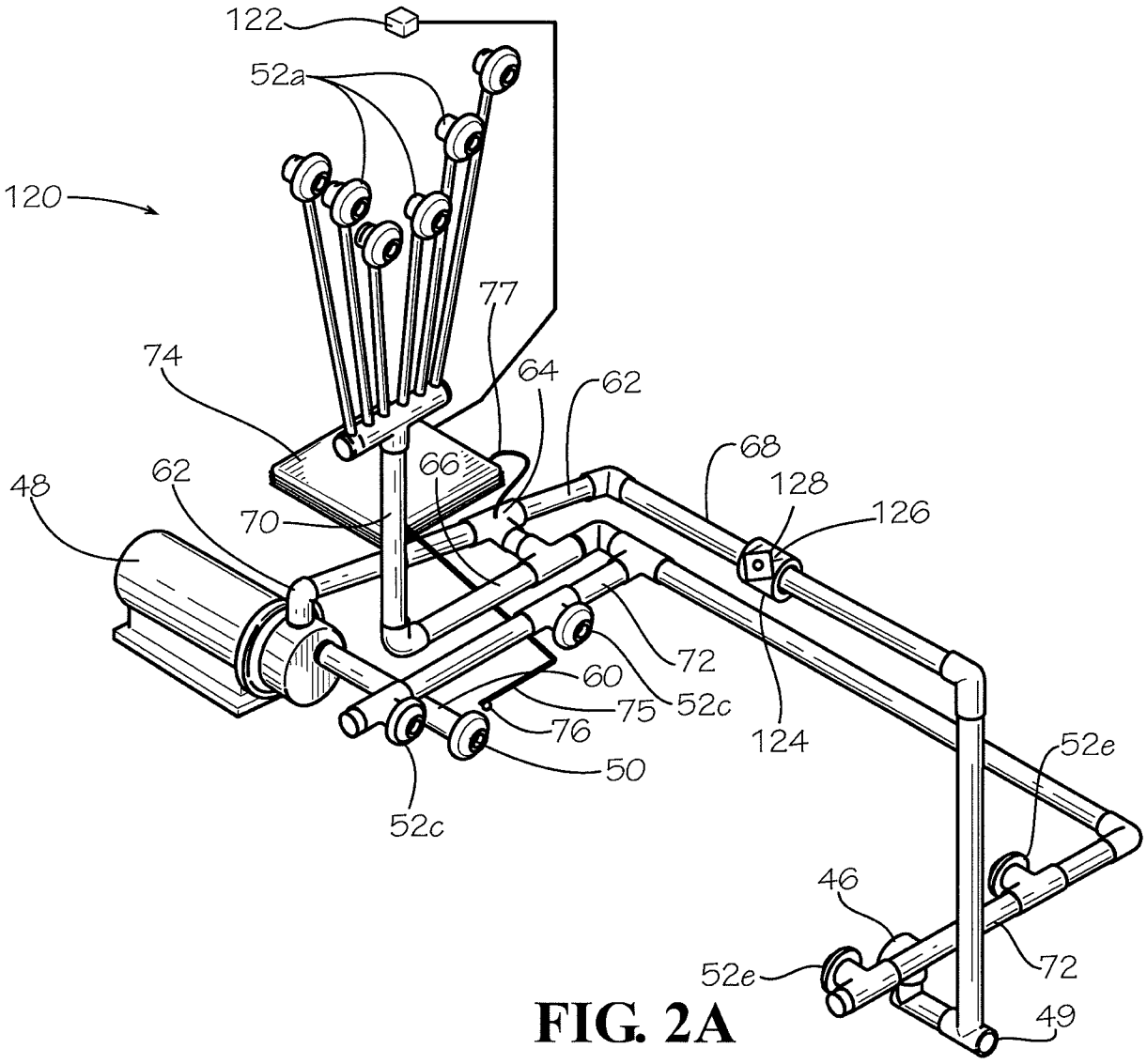
FIG. 2A illustrates in perspective view an alternate embodiment of a rapid drain apparatus selectively configured for circulating water within, and for draining water from, a walk-in bathtub.

FIG. 2A illustrates in perspective view an alternate embodiment of a rapid drain system 120 selectively configured for circulating water within, and for draining water from, the walk-in bathtub 12. This embodiment incorporates the structure of the rapid drain system 10 discussed above but is illustrated as optionally using a high water level sensor 122 to detect a high water level and communicate a signal to the controller 74, rather than the open overflow outlet 44 shown in FIG. 2. In response to the signal from the high water level sensor 120, the controller 74 activates the rapid drain system to lower the water level to avoid a water overflow over an upper edge of the bathtub 12, as discussed below. The alternate embodiment rapid drain system 120 further includes a reverse check valve 124 having a closed position that prevents water flow through the check valve and an open position for water flow. The reverse check valve 124 shown in cut-away view is biased such as with a spring 126 to position a flow plate 128 to a closed position preventing inflow of water into the reverse check valve. The spring 126 holds the flow plate 128 closed. The pump 48 when operated with the diverter valve 64 open to the water drain 49 provides a water flow pressure sufficient to overcome the spring 126 loading and cause the plate 128 to move to the second or open position for water flow through the check valve to the drain 49. The operation of the pump facilitates accelerated draining, or rapid or quick draining, of water from the upper portions of the bathtub cavity to a water level less than the threshold, so that a user of the bathtub may sooner egress while the residual water in a footwell portion may gravity drain through a drain opening typically in a floor of the bathtub.

Figure 2B:
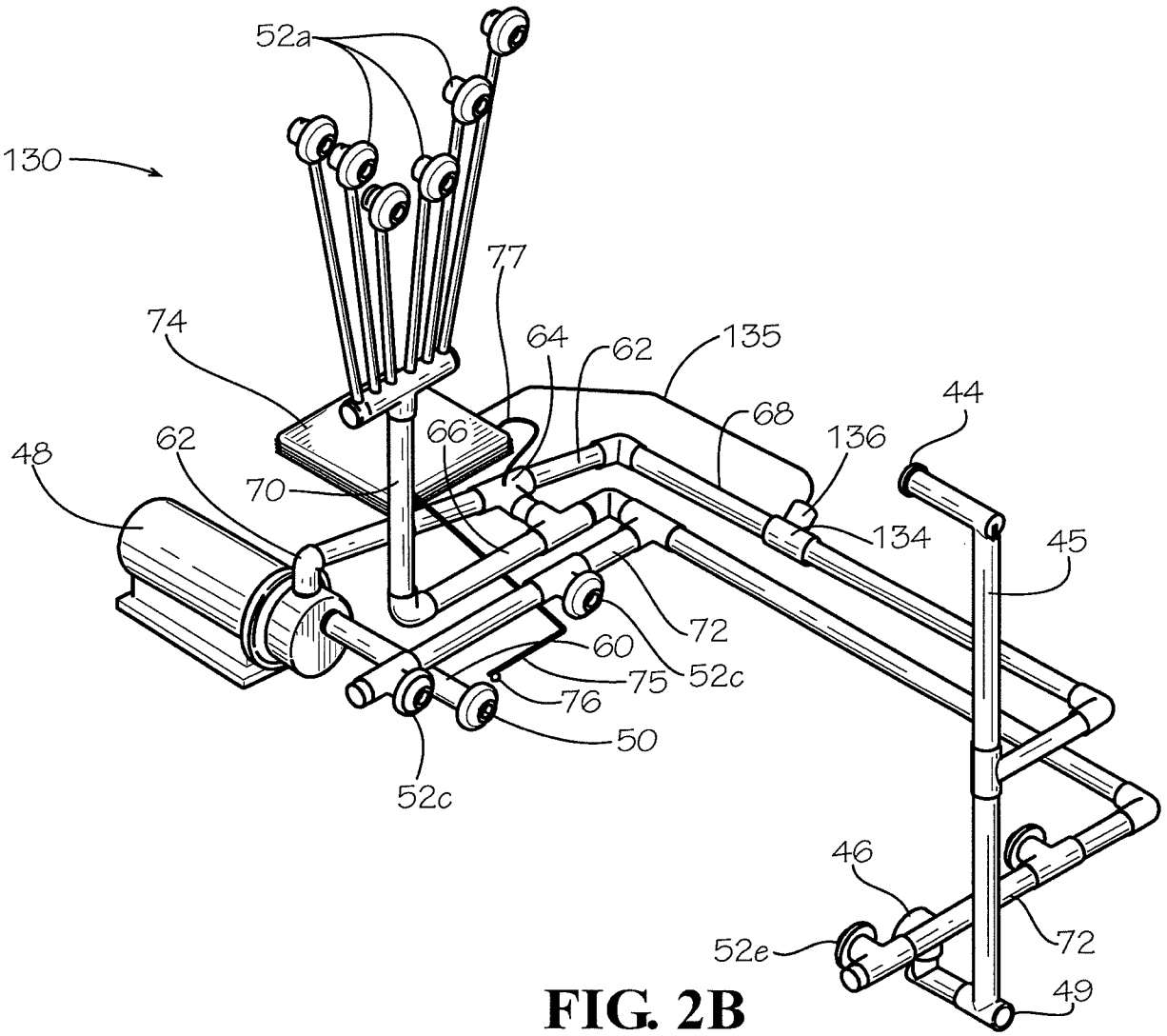
FIG. 2B illustrates in perspective view an alternate embodiment of a rapid drain apparatus selectively configured for circulating water within, and for draining water from, a walk-in bathtub.

FIG. 2B illustrates in perspective view an alternate embodiment of a rapid drain system 130 selectively configured for circulating water within, and for draining water from, the walk-in bathtub 12. This embodiment is illustrated as optionally using the open overflow outlet 44 shown in FIG. 2 but in an alternate embodiment uses the high water sensor 120 discussed above. The alternate embodiment rapid drain system 130 includes a remote operated reverse check valve 134 having a closed position that prevents water flow through the check valve and an open position for water flow. The reverse check valve 134 is biased closed. The controller 74 operates the check valve 134 through a communications link 135. The reverse check valve 134 may be operated electrically or pneumatically (with an air pump not illustrated) with a solenoid 136. The reverse check valve 134 biased closed to prevent flow of water through the reverse check valve to the drain 49. To rapid drain water from the bathtub 12, the reverse check valve 134 is operated to the second open position and the diverter valve 64 is operated to open to the drain 49. The pump 48 when then operated with the diverter valve 64 open to the water drain 49 (closed to the jets 52) pumps water rapidly from the inlet 50 to the drain 49 to facilitate quick or accelerated draining of water from the bathtub to a level less than the threshold whereupon the user may exit while residual water in a footwell portion gravity drains through a drain in the floor of the bathtub.

Figure 3:
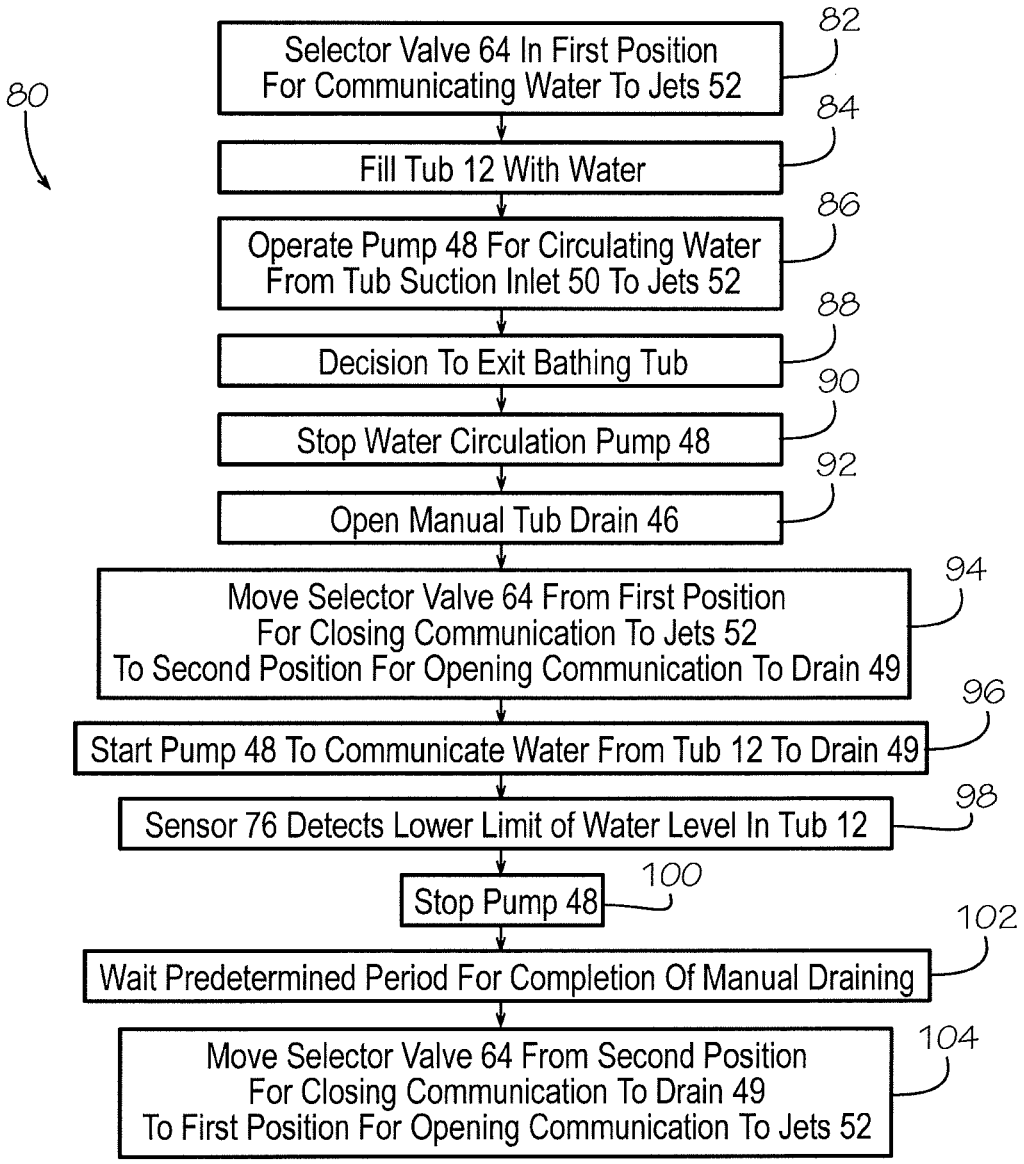
FIG. 3 illustrates a process flow for the apparatus illustrated in FIG. 2 for circulating water within, and for draining water from, the walk-in bathtub.

FIG. 3 illustrates a process flow 80 for the bathtub draining apparatus 10 illustrated in FIG. 2 for circulating water within, and for draining water from, the walk-in bathtub 12. The process flow 80 commences with an empty bathtub cavity 26. The bather opens the door 24 to enter the bathtub 12. The bather closes and secures the door 12 such as with a locking door handle to prevent inadvertent opening during use of the bathtub. The valve 64 is in the first position 82. The bather attends to filling 84 the bathtub cavity 26 with water using the water supply valves 40, 42. The water flows through the spout 38 into the cavity 26. Once a predetermined water depth is reached, the bather may operate 86 the pump 48 for circulating water within the bathtub. The controller 74 monitors the lower limit water sensor 76 and restricts pump operation if the water level is below the sensor. This prevents potential cavitation of the pump receiving air through the intake 50.

After appropriate bathing, the bather determines 88 to finish and depart the bathtub 12. This is accomplished by first draining the bathtub cavity 26 to at least a level below the threshold 25. The bather stops 90 the pump 48 to stop water circulating within the bathtub 12 through the jets 52. The bather opens 92 the main floor drain 46. Water begins gravity draining from the cavity 26 through the drain to the sanitary sewer. To assist emptying the cavity of water, the bather selectively activates the power drain feature. The bather operates 94 a drain switch to signal the controller 74 to commence power draining. The controller 74 first signals the valve 64 to move from the first position to the second position. This closes the circulation path from the pump 48 to the jets 52 and opens the drain conduit 68 to the pressure side of the pump. The pump 48 operates 96 to receive water through the intake 50 and communicate the water through the valve 64 and the drain conduit 68 to the drain pipe 45. Water in the cavity 26 thereby drains (1) by gravity through the main floor 46 and (2) by the pump with water flowing through the intake 50, the valve 64 and drain conduit 68, into the drain pipe for discharge into the sanitary sewer system.

The controller 74 continues to receive signals from the lower limit water sensor 76. The signal from the sensor 76 changes when the water level drops below the sensor. This indicates the water level has dropped to proximate an upper edge of the intake opening 50. Upon detecting 98 the change in the signal from the sensor 76, the controller 74 stops 100 the pump 48. This prevents cavitation. The water however continues to drain from the cavity 26 by gravity through the main floor drain 46. The bather may open the door 24 and exit the bathtub 12 because the water in the lower portion of the cavity 26 is below the threshold 25. The water in the drain conduit 68 flows back through the pump 48 and the intake 50 into a lower portion of the cavity 26. A predetermined period 102 provides for complete draining of the water from the cavity 26. Upon expiration of the period, the controller 74 signals the valve 64 to operate. The controller 74 causes 104 the valve 64 to move 100 from the second position to the first position. This positions the drain apparatus 10 closed for drainage and open for filing of the bathtub 12 and for communication of water within the cavity for circulating flow of water through the intake and the jets upon activation of the pump 48.

Figure 4:
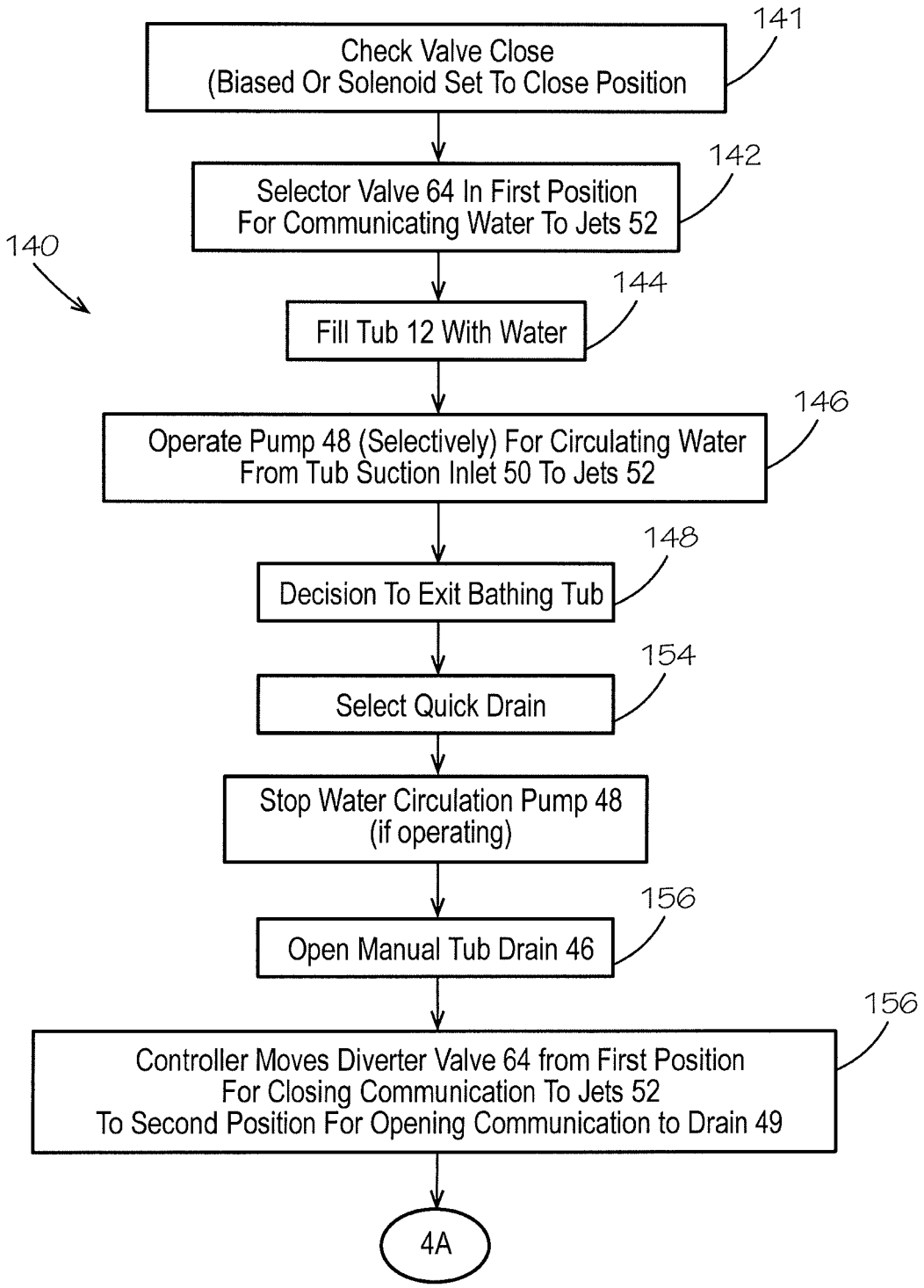
FIGS. 4 and 4A illustrate a process flow for the apparatus illustrated in FIGS. 2A and 2B for circulating water within, and for draining water from, the walk-in bathtub.
Figure 4A:
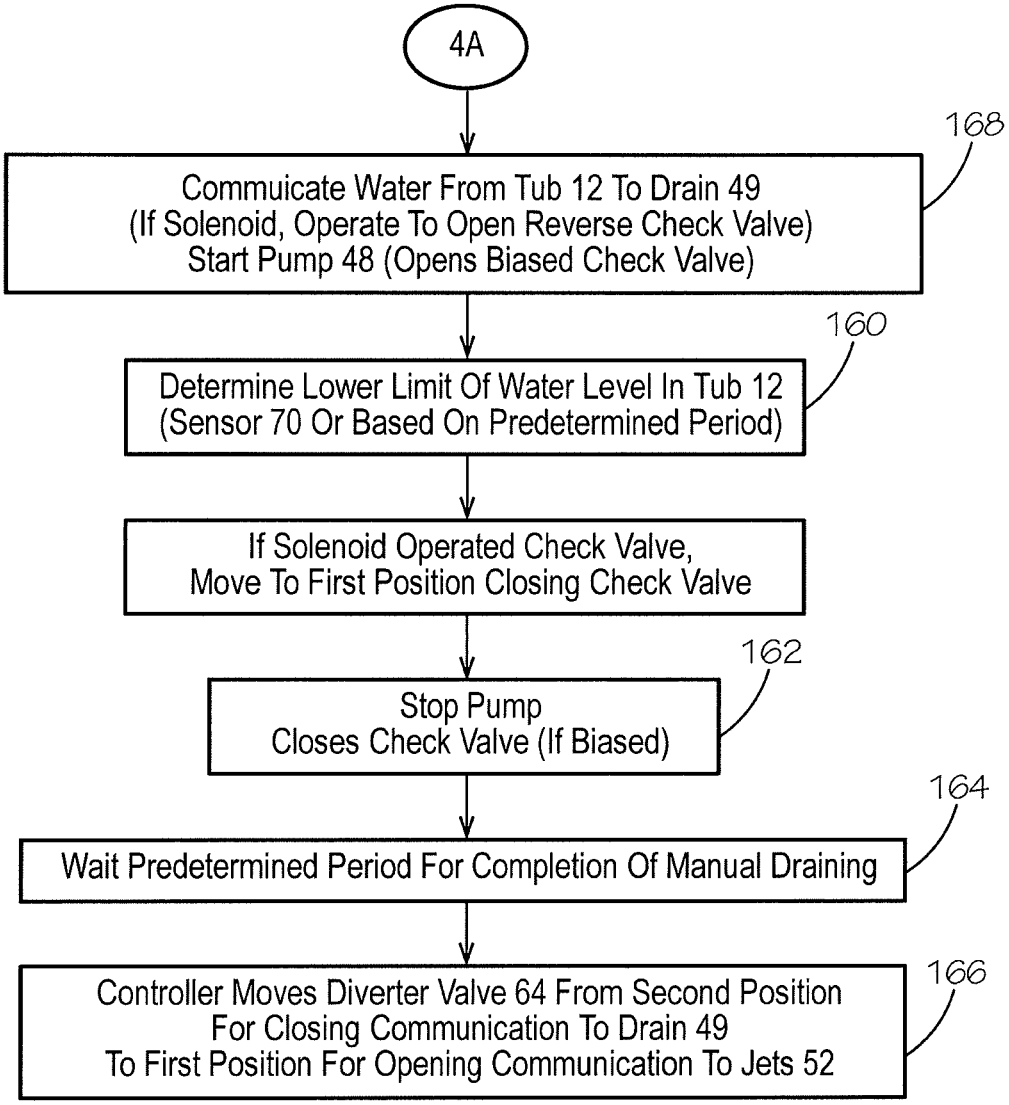

FIGS. 4 and 4A illustrate a process flow 140 for the bathtub draining apparatus 120/130 illustrated in FIGS. 2A and 2B for circulating water within, and for draining water from, the walk-in bathtub 12. The process flow 140 commences 141 with the reverse check valve 124/134 in the closed position and with the bathtub cavity 26 empty. The bather opens the door 24 to enter the bathtub 12. The bather closes and secures the door 12 such as with a locking door handle to prevent inadvertent opening during use of the bathtub. The valve 64 is in the first position 142 (i.e., open for communication with the recirculation of water through the jets 52 and closed for communication with the drain 49). The bather attends to filling 144 the bathtub cavity 26 with water using the water supply valves 40, 42. The water flows through the spout 38 into the cavity 26. Once a predetermined water depth is reached, the bather may operate 146 the pump 48 for circulating water within the bathtub (i.e., through the inlet 50, through the pump, and directed by the diverter valve 64 to the jets 52). The controller 74 monitors the lower limit water sensor 76 and restricts pump operation if the water level is below the sensor. This prevents potential cavitation of the pump receiving air through the intake 50.

After appropriate bathing, the bather determines 148 to finish and depart the bathtub 12. This is accomplished by first draining the bathtub cavity 26 to at least a level below the threshold 25. The bather stops 150 the pump 48 (if operating) to stop water circulating within the bathtub 12 through the jets 52. The bather opens 152 the main floor drain 46. Water begins gravity draining from the cavity 26 through the drain to the sanitary sewer. To assist emptying the cavity of water, the bather selectively activates 154 the power drain or rapid drain feature.

In the embodiment illustrated in FIG. 2A, the bather operates a rapid drain switch to signal the controller 74 to commence power draining. The controller 74 first signals the diverter valve 64 to move 156 from the first position to the second position. This closes the circulation path from the pump 48 to the jets 52 and opens the drain conduit 68 to the pressure side of the pump to the drain. The pump 48 operates 158 to receive water through the intake 50 and communicate the water through the valve 64 and the drain conduit 68 to the drain pipe 45. Water in the cavity 26 thereby drains (1) by gravity through the main floor 46 and (2) by the pump with water flowing through the intake 50, the valve 64, the drain conduit 68, through the open check valve 136, to the drain 49 for discharge into the sanitary sewer system.

In the embodiment illustrated in FIG. 2B, the bather operates a rapid drain switch to signal the controller 74 to commence power draining. The controller 74 first signals the diverter valve 64 to move 156 from the first position to the second position. This closes the circulation path from the pump 48 to the jets 52 and opens the drain conduit 68 to the pressure side of the pump to the drain. The pump 48 operates 158 to receive water through the intake 50 and communicate the water through the valve 64 and the drain conduit 68 to the drain pipe 45. The pressure of the water from the pump 48 moves the plate 128 against the biasing spring 126 and opens the check valve 124 to water flow. Water in the cavity 26 thereby drains (1) by gravity through the main floor 46 and (2) by the pump with water flowing through the intake 50, the valve 64, the drain conduit 68, through the open check valve 124, to the drain 49 for discharge into the sanitary sewer system.

The controller 74 continues to receive signals from the lower limit water sensor 76. The signal from the sensor 76 changes 160 when the water level drops below the sensor. This indicates the water level has dropped to proximate an upper edge of the intake opening 50 (or at least a level lower than the threshold 25). Upon detecting the change in the signal from the sensor 76, the controller 74 stops 162 the pump 48. This prevents cavitation. An alternate embodiment may rely on the operation of the pump for a predetermined period sufficient to drain a maximum volume of water from the bath tub to a lower water level proximate or below the upper edge of the water intake 50. Some cavitation may occur such as for water volumes where the water level is less than the high water level.

The water however continues to drain from the cavity 26 by gravity through the main floor drain 46. The bather may open the door 24 and exit the bathtub 12 because the water in the lower portion of the cavity 26 is below the threshold 25. The water in the drain conduit 68 flows back through the pump 48 and the intake 50 into a lower portion of the cavity 26. A predetermined period 164 provides for complete draining of the water from the cavity 26. Upon expiration of the period, the controller 74 signals the diverter valve 64 to operate. The controller 74 causes 166 the valve 64 to move 100 from the second position to the first position. This positions the drain apparatus 10 closed for drainage and open for filing of the bathtub 12 and for communication of water within the cavity for circulating flow of water through the intake and the jets upon activation of the pump 48. In the embodiment illustrated in FIG. 2A, the stopping of the pump 48 allows the biased reverse check valve 124 to close to water flow through the check valve. In the embodiment illustrated in FIG. 2B, the controller 74 operates the check valve 134 to move to the closed position closing water flow to the drain 49.

The bathtub may use in one embodiment the high-water level sensor 120 (rather than the high water opening 44) to prevent overflow. The sensor 120 signals the controller 74 of a detected high-water level. The controller 74 then operates the diverter valve 64 to move to the second position for communicating water to the drain 49 and operates the reverse check valve 124, 134 to move to the reverse check valve second position. In the embodiment illustrated in FIG. 2A, the movement of the reverse check valve is accomplished by operating the pump 48 and the pressure of the pumped water causes the plate 128 to open against the biasing spring 126 and allow water to flow to the drain 49. After a predetermined period sufficient to lower the water level in the bathtub, the controller 74 stops the pump. The reverse check valve 124 returns to the first position closed to water flow by the biasing spring 126 that moves the plate 128 closed. The controller 74 operates the diverter valve 66 to move the diverter valve to the first position for recirculating water in the bathtub.

In the embodiment illustrated in FIG. 2B, the movement of the reverse check valve is accomplished by operating the solenoid 136. The pump 48 is operated to accelerate water draining from the bathtub. After a predetermined period sufficient to lower the water level in the bathtub, the controller 74 stops the pump. The controller moves the reverse check valve 134 to the first position by operating the solenoid 136 to close to water flow. The controller 74 operates the diverter valve 66 to move the diverter valve to the first position for recirculating water in the bathtub.

It is to be appreciated that the present invention facilitates prompt and accelerated drainage of water from the cavity 26, to reduce the amount of time a bather must wait before the door 24 may be opened for egress. In a configuration having a 1½ inch drain line, and a ¼ HP water pump, the drain apparatus 10 may reduce drain time by about 5-8 minutes, depending on the volume of water within the cavity 26. In a first embodiment, the drain apparatus 10 may be configured to leave the valve 64 in the second position for an extended period after the pump, being operated for draining water, is turned off. This assures that the water in the drain conduit 68 flows back through the pump 48 and through the main floor drain 46. Upon completion of the predetermined period, the controller moves the valve 64 to the first position. The controller thereby configures the bathtub 12 for the next use for filling and bathing with the valve 64 in the first position closing the drain conduit 68. For a typical configuration having a residual water volume of about 5-8 gallons in the lower portion of the foot well (below the threshold height), a predetermined period of about 1 to about 4 minutes is sufficient to allow the residual water to drain though the main floor drain 46.

In an alternate embodiment, the dwell period for the valve to remain in the second position is a predetermined period commencing when the pump starts in drain mode after the bather selectively activates the assisted draining apparatus. In such embodiment, a bathtub holding 120 gallons and a drain flow rate of 10 gallons per minute, the predetermined period of between about 8 minutes to about 12 minutes provides for power assisted draining to the lower limit sensor and gravity drain for residual water before the controller moves the valve 64 to the first position.

In an alternate embodiment, the walk-in bathtub is configured for the bather to manually configure the pump and drain apparatus. The bather stops the pump that circulates the bath water through the jet nozzles. The bather then opens the main floor drain 46 (such as using conventional fixture lift rod or rotatable plug received in a drain seat). The water begins gravity draining from the walk-in-bathtub. To advance the progress of draining, the bather moves the valve from the first circulation position to the second drain position. In this alternate embodiment, this is accomplished by the bather operating a switch that communicates with the controller. The controller, in response, causes the valve to move to the second position. The controller starts the pump to communicate bath water through the intake 50 and through the drain conduit 68 to discharge into the sanitary sewer. The low level water sensor signals the controller when the water level drops below the sensor (such as at or about the height of the threshold). The controller stops the pump and waits a predetermined period. During the dwell period, the water continues draining from the main floor drain 46 to the sanitary sewer. The period is sufficient for the residual water, including that in the drain conduit 68, to drain from the foot well of the bathtub 12. The controller than moves the valve 64 to the first position, to prepare the bathtub 12 for subsequent filling and use as a walk-in bathtub.

The present invention accordingly provides an apparatus and method for accelerating drainage of bath water from a walk-in bathtub. While this invention has been described in detail with particular references to illustrated embodiments thereof, it should be understood that many modifications, additions and deletions, in additions to those expressly recited, may be made thereto without departure from the spirit and scope of the invention recited in the appended claims.

What is claimed is:

1. A quick drain system for a walk-in bathtub, comprising:

a walk-in bathtub having a door in a side wall movable between a closed position with a seal for holding water within the bathtub and an open position for entering and egressing from the bathtub, said walk-in bath tub having a foot well portion for holding water below a threshold of the door and a water recirculation piping for communicating water to a plurality of j et openings in sidewalls of the bathtub; and said quick drain system comprising:

a water outlet in a side wall of the bathtub proximate or lower than said threshold;

a water supply pipe for communicating water from the water outlet to a diverter valve;

said diverter valve having a first position for communicating water to the water recirculation piping and a second position for communicating water to a water drain pipe;

the water drain pipe for connecting to a sanitary sewer pipe for draining water from the bathtub;

a reverse check valve positioned in the water drain pipe prior to the connection with the sanitary sewer pipe and operable selectively to a check valve first position closed to prevent water flow from the diverter valve through the reverse check valve and to a check valve second position open to allow water flow from the diverter valve through the reverse check valve for draining of the bathtub; and means for operating selectively the reverse check valve to move to the check valve second position for draining water from the bathtub, whereby the quick drain system, being closed to drainage of water from the bathtub by the reverse check valve, allows the bathtub to fill with water and the reverse check valve being selectively operated to move to the check valve second position and the diverter valve not in the first position, allows water in the bathtub to drain to the sanitary sewer pipe.

2. The quick drain system as recited in claim 1, wherein the reverse check valve is biased closed.

3. The quick drain system as recited in claim 2, wherein the reverse check valve is operated by solenoid configured to close the reverse check valve until operated to move the reverse check vale to the check valve second position.

4. The quick drain system as recited in claim 2, wherein the reverse check valve comprises a spring that biases the reverse check valve closed unless a load force is applied in the reverse check valve to overcome the biasing spring for opening to water flow.

5. The quick drain system as recited in claim 1, wherein the means for operating comprises a pump having an inlet that connects to the water outlet in the side wall and an outlet that connects to the diverter valve, the pump when operating and the diverter valve is not in the first position, for pumping water at a fluid pressure greater than the bias force of the reverse check valve, to cause the reverse check valve to the check valve second position open for draining water from the bathtub.

6. The quick drain system as recited in claim 5, wherein the pump being operated with the diverter valve in the first position recirculates water through the jets into the bathtub.

7. The quick drain system as recited in claim 5, wherein the water supply pipe connects to the outlet in the side wall and the inlet of the pump; and further comprising a second water supply pipe that connects from the outlet of the pump to the diverter valve.

8. The quick drain system as recited in claim 5, further comprising means for preventing water overflow during filling of the bathtub.

9. The quick drain system as recited in claim 8, wherein means for preventing water overflow comprises an upper sensor for detecting a high water level, and further comprising a controller that upon detection of the high water level, moves the diverter valve to the second position and operates the means for operating the reverse check valve to open the reverse check valve for draining water from the bathtub.

10. The quick drain system as recited in claim 9, wherein the means for operating comprises a solenoid configured to close the reverse check valve until operated to open the reverse check valve.

11. The quick drain system as recited in claim 9, wherein the means for operating comprises the controller for operating the pump to apply a fluid pressure load force in the reverse check valve that is greater than the bias force of the reverse check valve to open the reverse check valve.

12. The quick drain system as recited in claim 11, wherein the controller stops the pump after a predetermined period and moves the diverter valve to the first position.

13. The quick drain system as recited in claim 8, wherein the means for preventing overflow comprises an upper opening in a sidewall of the bathtub and a second water drain pipe connected from the upper opening to a connector proximate but after the reverse check valve.

14. The quick drain system as recited in claim 13, further comprising a drain opening in a floor of the bathtub; and a third drain pipe connected between the drain opening and the second water drain pipe.

15. The quick drain system as recited in claim 1, wherein the means for operating comprises a motivator for moving the reverse check valve from the first position to the second position and with the diverter valve not in the first position water drains from the bathtub through the check valve.

16. The quick drain system as recited in claim 15, wherein the motivator comprises a solenoid device operative to move the reverse check valve to the second position.

17. The quick drain system as recited in claim 16, wherein the solenoid is pneumatic.

18. The quick drain system as recited in claim 16, wherein the solenoid is electrical.

19. The quick drain system as recited in claim 15, further comprising means for preventing water overflow during filling of the bathtub.

20. The quick drain system as recited in claim 19, wherein means for preventing water overflow comprises an upper sensor for detecting a high water level, and further comprising a controller that upon detection of the high water level, operates the motivator to open the reverse check valve for draining water from the bathtub.

21. The quick drain system as recited in claim 20, wherein the controller stops the pump after a predetermined period and moves the diverter valve to the first position.

22. The quick drain system as recited in claim 19, wherein the means for preventing overflow comprises an upper opening in a sidewall of the bathtub and a second water drain pipe connected from the upper opening to a connector proximate but after the reverse check valve.

23. The quick drain system as recited in claim 22, further comprising a drain opening in a floor of the bathtub; and a third drain pipe connected between the drain opening and the second water drain pipe.

24. A method for rapid draining water from a walk-in bathtub having a door in a side wall movable between a closed position with a seal for holding water within the bathtub and an open position for entering and egressing from the bathtub, said walk-in bath tub having a foot well portion for holding water below a threshold of the door and a water recirculation piping for communicating water to a plurality of jet openings in sidewalls of the bathtub, comprising the steps of:

(a) biasing a diverter valve in a quick drain system to a first position for communicating water from a water outlet in a side wall of the bathtub to the water recirculation piping, said diverter valve selectively movable to a second position for communicating water to a water drain pipe, the water outlet lower than the threshold of the door;

(b) biasing a reverse check valve in the water drain pipe of the quick drain system to a check valve first position closed to prevent water flow from the diverter valve through the check valve and moveable selectively to a check valve second position open to allow water flow from the water outlet through the diverter valve and the reverse check valve for draining of the bathtub;

(c) moving the diverter valve to the second position; and (d) moving the reverse check valve to the check valve second position, whereby water within the bathtub communicates through the water outlet through the diverter valve and the reverse check valve for draining, whereby the quick drain system, being closed to drainage of water from the bathtub by the diverter valve and the reverse check valve, allows the bathtub to fill with water and the reverse check valve being selectively operated to move to the check valve second position and the diverter valve not in the first position, allows water in the bathtub to drain from the bathtub.

25. The method for rapid draining as recited in claim 24, wherein the step of moving the reverse check valve comprises operating a solenoid to move the reverse check valve to the check valve second position.

26. The method for rapid draining as recited in claim 25, further comprising the step of operating a pump to pump water from the water outlet.

27. The method for rapid draining as recited in claim 24, wherein the step of moving the reverse check valve comprises operating a pump to pump water from the water outlet to the diverter valve at a pressure to move the reverse check valve to the check valve second position.

* * * * *